US008752286B2

(12) United States Patent
Kataoka et al.

(10) Patent No.: US 8,752,286 B2
(45) Date of Patent: Jun. 17, 2014

(54) METHOD OF MANUFACTURING WIRE HARNESS

(75) Inventors: Yuta Kataoka, Hitachi (JP); Hideaki Takehara, Kitasaku-gun (JP); Kunihiro Fukuda, Tsukuba (JP); Sachio Suzuki, Hitachi (JP); Jun Umetsu, Hitachi (JP); Shinya Hayashi, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 44 days.

(21) Appl. No.: 13/484,158

(22) Filed: May 30, 2012

(65) Prior Publication Data

US 2012/0324726 A1 Dec. 27, 2012

(30) Foreign Application Priority Data

Jun. 22, 2011 (JP) ..... 2011-138338
Feb. 3, 2012 (JP) ..... 2012-021761

(51) Int. Cl.
*H01R 43/00* (2006.01)

(52) U.S. Cl.
USPC ..... 29/857; 29/825; 29/592.1; 439/692; 439/660; 439/626; 439/625; 439/604

(58) Field of Classification Search
USPC ..... 29/857, 825, 592.1; 439/692, 660, 626, 439/625, 604, 606
See application file for complete search history.

(56) References Cited

U.S. PATENT DOCUMENTS 5,456,791 A * 10/1995 Ueno ..... 156/556
5,926,952 A * 7/1999 Ito ..... 29/883
6,218,619 B1 * 4/2001 Asakura et al. ..... 174/78
6,250,972 B1 * 6/2001 Shinchi et al. ..... 439/752
6,485,325 B1 11/2002 Fukuda
6,840,804 B2 * 1/2005 Murakami et al. ..... 439/587
6,854,996 B2 * 2/2005 Yaworski et al. ..... 439/276
6,984,150 B2 * 1/2006 Kondou et al. ..... 439/606
7,390,217 B2 * 6/2008 Scott ..... 439/604
8,192,230 B2 * 6/2012 Kataoka et al. ..... 439/604
8,202,115 B2 * 6/2012 Suzuki et al. ..... 439/604
8,277,250 B2 * 10/2012 Suzuki et al. ..... 439/604
8,308,510 B2 * 11/2012 Suzuki et al. ..... 439/587
2001/0003688 A1 * 6/2001 Kondo ..... 439/604
2001/0049226 A1 12/2001 Murakami et al.
2011/0159728 A1 6/2011 Suzuki et al.
2012/0329337 A1 * 12/2012 Kataoka et al. ..... 439/692

FOREIGN PATENT DOCUMENTS

JP 2000-353566 A 12/2000
JP 2001-345143 A 12/2001
JP 2011-134602 A 7/2011

* cited by examiner

*Primary Examiner* — Peter DungBa Vo
*Assistant Examiner* — Azm Parvez
(74) *Attorney, Agent, or Firm* — McGinn IP Law Group, PLLC

(57) ABSTRACT

A method of manufacturing a wire harness including a plurality of wires and a connector with a housing. The method includes arranging the plurality of wires in an insertion hole of an airtight block of the housing to have a gap between the plurality of wires and an inner surface of the insertion hole, supplying a molten resin having a fluidity into the gap through a flow channel in communication with the gap, and solidifying the molten resin inside the space to resin-seal the gap between the insertion hole and the plurality of wires. The supplying of the molten resin is conducted such that a tool for melting a solid resin member is attached to the airtight block, the resin member is melted by applying an ultrasonic vibration while being pressed against the tool, and the molten resin obtained by the melting is poured into the flow channel.

7 Claims, 14 Drawing Sheets

(a)

(b)

METHOD OF MANUFACTURING WIRE HARNESS

The present application is based on Japanese patent application Nos. 2011-138338 and 2012-021761 filed on Jun. 22, 2011 and Feb. 3, 2012, respectively; the entire contents of which are incorporated herein by reference.

BACKGROUND OF THE INVENTION

1. Field of the Invention

The invention relates to a method of manufacturing a wire harness including plural wires and a connector with a housing for holding end portions of the plural wires.

2. Description of the Related Art

In a conventional wire harness provided with plural wires and a connecter provided at end portions of the plural wires, a gap between a housing of the connector and the wires is air-tightly sealed in order to prevent failure which is caused by moisture, etc., entering inside the connector (see, e.g., JP-A-2001-345143 and JP-A-2000-353566).

In the connector described in JP-A-2001-345143, plural insertion holes for inserting the respective plural wires are formed on the housing and rubber plugs fitted to the respective wires are inserted into the insertion holes to seal between the wires and the insertion holes.

However, in the connector having such a structure, the rubber plugs and a thick portion of the housing for partitioning the insertion holes are interposed between the adjacent wires and narrowing intervals between the adjacent wires is thus limited, which hinders downsizing/weight reduction of the connector.

On the other hand, in a waterproof structure of a connector described in JP-A-2000-353566, a wire lead-out portion which is formed of resin and provided on a connector is heat-welded to a resin coating of a wire by ultrasonic vibration to ensure waterproof properties. This waterproof structure facilitates downsizing/weight reduction of the connector as compared to the structure of the connector described in JP-A-2001-345143 since a sealing member such as rubber plug is not used.

SUMMARY OF THE INVENTION

However, in the waterproof structure of a connector described in JP-A-2000-353566, a material which can be melted and adhered to the resin of the connector needs to be selected for the resin coating of the wire, which is restriction in designing. In addition, since the resin coating of the wire is melted, a thickness of the resin coating may need to be set to greater than a thickness required for protecting a core wire by taking into consideration of the melting amount of the resin coating.

Accordingly, the present applicant previously proposed a wire harness in which a gap between a housing and cables (wires) is sealed with a melting member formed of a resin which can be thermally melted, and a method of manufacturing the same (see Japanese patent application No. 2009-293345).

In this wire harness, the melting member is inserted into a cable insertion hole through an insertion portion formed on the housing and is pressed against a pressure receiving portion formed on an inner surface of the cable insertion hole while vibrating the melting member by an ultrasonic vibration horn to melt a front end portion of the melting member which is in contact with the pressure receiving portion, and the molten resin is poured into a gap between the cables and the cable insertion holes so that peripheries of the cables are covered with the molten resin, thereby ensuring air-tightness of the housing.

However, not only the melting member but also the pressure receiving portion of the housing may be melted at the time of pressing and simultaneously vibrating the melting member and it is not possible to supply sufficient molten resin to a gap between the cables and the cable insertion hole in such a case, hence, there is still room for improvement.

Accordingly, it is an object of the invention to provide a method of manufacturing a wire harness that a molten resin melted by applying ultrasonic vibration can be supplied to a gap between a housing and cables without melting the housing by the ultrasonic vibration.

(1) According to one embodiment of the invention, a method of manufacturing a wire harness comprising a plurality of wires and a connector with a housing for holding end portions of the plurality of wires comprises:

arranging the plurality of wires in an insertion hole of an airtight block of the housing to have a gap between the plurality of wires and an inner surface of the insertion hole, the insertion hole being formed in the airtight block for inserting the plurality of wires therethrough;

supplying a molten resin having a fluidity into the gap through a flow channel in communication with the gap; and solidifying the molten resin inside the space to resin-seal the gap between the insertion hole and the plurality of wires, wherein the supplying of the molten resin is conducted such that a tool for melting a solid resin member is attached to the airtight block, the resin member is melted by applying an ultrasonic vibration while being pressed against the tool, and the molten resin obtained by the melting is poured into the flow channel.

In the above embodiment (1) of the invention, the following modifications and changes can be made.

(i) The tool comprises a holding hole for holding the shaft-shaped resin member so as to be movable in an axis direction thereof, a lead-out path for guiding the molten resin to the outside of the tool, and a melting zone provided between the holding hole and the lead-out path to melt the resin member, and wherein the melting zone comprises a receiving surface against which the resin member is pressed so as to be melted by frictional heat generated by friction between the resin member and the receiving surface.

(ii) The melting zone comprises a gap that is larger than a gap between the inner surface of the holding hole and the resin member and formed around a region where friction between the receiving surface and the resin member occurs.

(iii) The lead-out path is opened to the outside of the tool at one end and opened on the receiving surface at another end, and the opening on the receiving surface side is formed at a position surrounded by the region where friction with the resin member occurs.

(iv) The resin member has configured such that a contact area with the receiving surface increases according to the melting.

(v) The resin member is formed so that an end portion to be housed in the tool has a tapered shape.

(vi) The resin member comprises a hollow formed at a shaft center in the end portion to be housed in the tool.

(vii) The supplying of the molten resin is conducted such that the resin member is melted while the tool is heated by a heating means.

Points of the Invention

According to one embodiment of the invention, a method of manufacturing a wire harness is conducted such that the resin member is melted outside the airtight block and the molten resin is supplied into the gap through the flow channel. Thus, the airtight block does not directly receive the ultrasonic vibration or heat generated by the ultrasonic vibration unlike in the case of melting the resin member inside the airtight block by applying the ultrasonic vibration thereto. Therefore, the airtight block can be prevented from being deformed by the heating.

BRIEF DESCRIPTION OF THE DRAWINGS

Next, the present invention will be explained in more detail in conjunction with appended drawings, wherein:

FIGS. 3A and 3B are diagrams illustrating an internal structure of male and female connectors in a state that the two connectors are coupled to each other, wherein FIG. 3A is a cross sectional view taken along a line B-B in FIG. 1 and FIG. 3B is a cross sectional view taken along a line C-C in FIG. 1;

FIGS. 12A and 12B show a state that the resin member is held by the melting tool, wherein FIG. 12A is a perspective view showing the melting tool and the resin member and FIG. 12B is a cross sectional view taken along a line G-G in FIG. 12A;

FIGS. 14A and 14B are explanatory diagrams illustrating the melting tool and the resin member in a supplying step and also show cross sectional views of an airtight block, wherein FIG. 14A shows a state before applying ultrasonic vibration to the resin member and FIG. 14B shows a state that the ultrasonic vibration is being applied to the resin member;

FIGS. 15A and 15B are explanatory diagrams illustrating a melting tool and a resin member in a modification of the first embodiment and also show cross sectional views of the airtight block, wherein FIG. 15A shows a state before applying ultrasonic vibration to the resin member and FIG. 15B shows a state that the ultrasonic vibration is being applied to the resin member;

FIGS. 16A and 16B are diagrams illustrating a melting tool and a resin member in a second embodiment, wherein FIG. 16A is a plan view and FIG. 16B is a cross sectional view taken along a line H-H in FIG. 16A; and FIGS. 17A and 17B are diagrams illustrating a melting tool and a resin member in a modification of the second embodiment, wherein FIG. 17A is a plan view and FIG. 17B is a cross sectional view taken along a line I-I in FIG. 17A.

DETAILED DESCRIPTION OF THE PREFERRED EMBODIMENTS

First Embodiment

Figure 1:
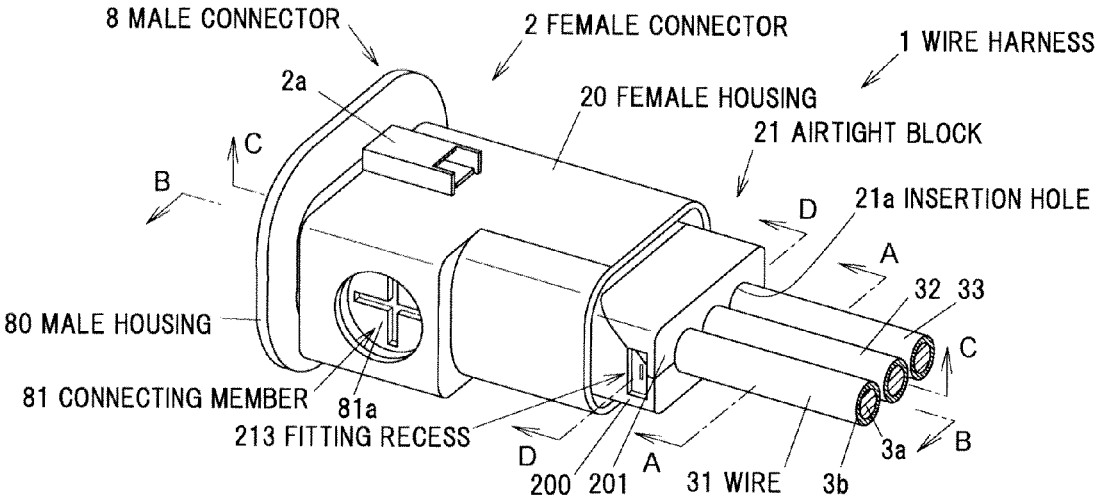
FIG. 1 is a perspective view showing a wire harness in a first embodiment of the present invention.
Figure 2:
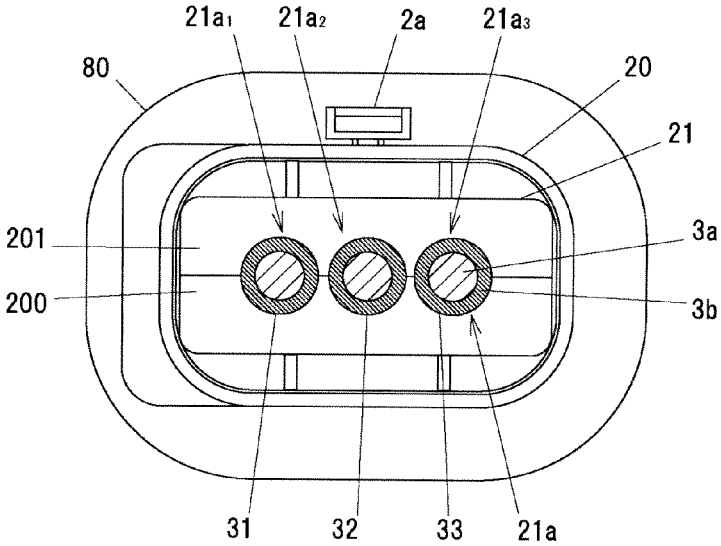
FIG. 2 is a cross sectional view taken along a line A-A in FIG. 1.

FIG. 1 is a perspective view showing a wire harness in a first embodiment of the invention FIG. 2 is a cross sectional view taken along a line A-A in FIG. 1. A wire harness 1 is used for supplying a driving current to, e.g., an electric motor as a drive source of a vehicle.

The wire harness 1 has a female connector 2 and three wires 31 to 33. The female connector 2 has a female housing 20 for holding end portions of the wires 31 to 33. The three wires 31 to 33 are aligned in one direction and are held by the female housing 20. The female housing 20 is formed of a resin, e.g., PPS (polyphenylene sulfide) resin, PPA (polyphthalamide) resin, PA (polyamide) resin or PBT (polybutylene terephthalate) resin, etc.

The female housing 20 has, at an end portion thereof from which the wires 31 to 33 are led out, an airtight block 21 formed of a resin in which an insertion hole 21*a* for inserting the wires 31 to 33 is formed. Meanwhile, a fitting recess 213 for fitting a below-described melting tool 5 is formed on the airtight block 21 at an end portion in an array direction of the wires 31 to 33. A gap between the airtight block 21 and the wires 31 to 33 is air-tightly sealed with a resin as described later.

The wires 31 to 33 are each composed of a central conductor 3*a* formed of a conductive metal, e.g., copper or aluminum, etc., and a sheath 3*b* formed of an insulating resin such as cross-linked polyethylene and formed on an outer periphery of the central conductor 3*a*.

FIG. 1 shows a state that the female connector 2 is coupled to a male connector 8. The male connector 8 has a male housing 80, and a portion of the male housing 80 is fitted inside the female housing 20. The female connector 2 and the male connector 8 are coupled to each other by a locking mechanism 2*a* so as not to be easily detached.

The male connector 8 also has a connecting member 81 (described later) which is rotatable held by the male housing 80. A cross-shaped groove for turning the connecting member 81 by a tool such as driver is formed on a head portion 81*a* of the connecting member 81.

Female Connector 2

Figure 3A:
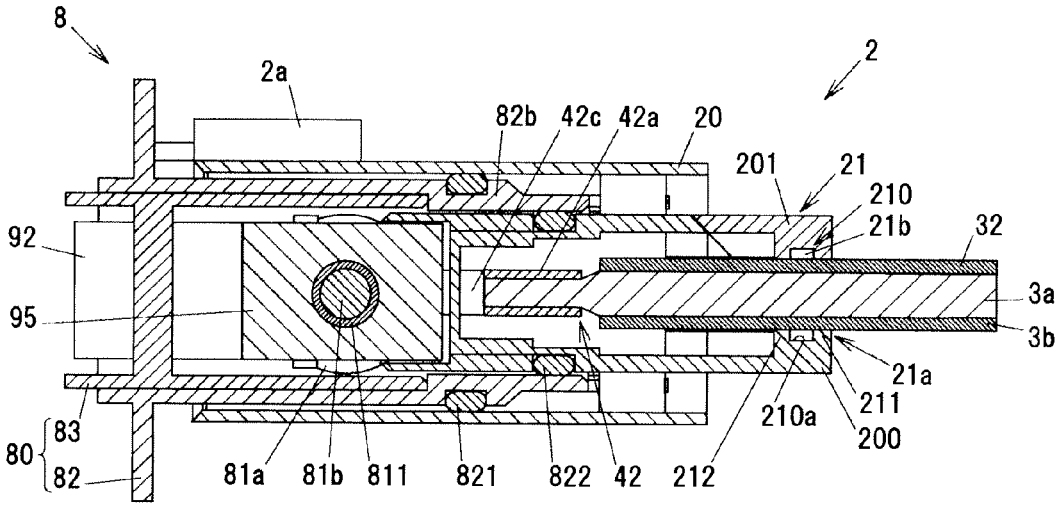
Figure 3B:
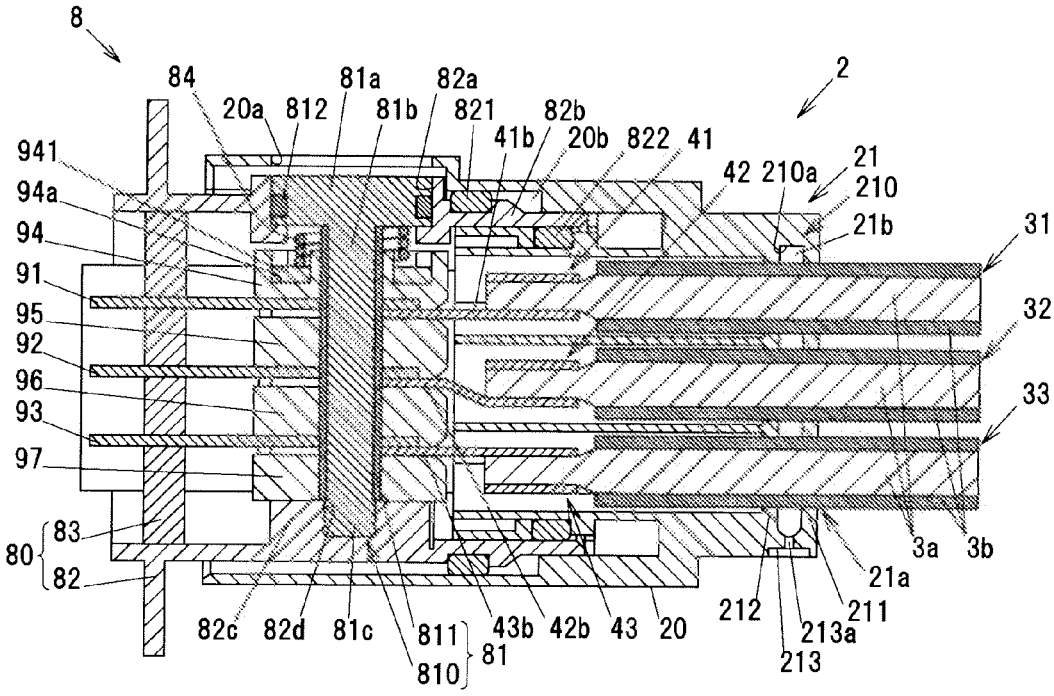

FIGS. 3A and 3B are diagrams illustrating an internal structure of the female connector 2 and the male connector 8 in a coupled state, wherein FIG. 3A is a cross sectional view taken along a line B-B in FIG. 1 and FIG. 3B is a cross sectional view taken along a line C-C in FIG. 1.

As shown in FIG. 3B, the sheaths 3*b* at the end portions of the wires 31 to 33 on the female connector 2 side are removed to expose the central conductors 3*a*. A connecting terminal 41 is connected to the central conductor 3*a* of the wire 31, a connecting terminal 42 is connected to the central conductor 3*a* of the wire 32 and a connecting terminal 43 is connected to the central conductor 3*a* of the wire 33.

Figure 4A:
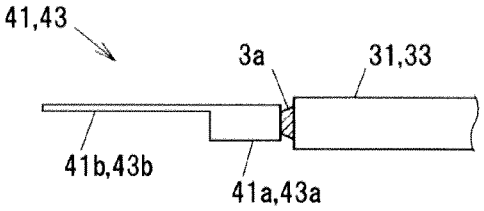
FIGS. 4A and 4B are appearance diagrams illustrating a shape of a connecting terminal provided on the female connector.
Figure 4B:
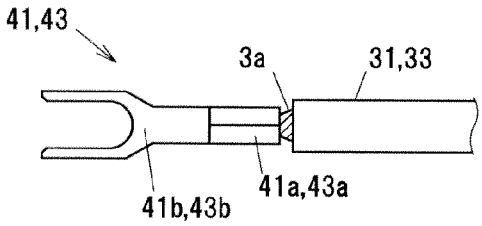
Figure 5A:
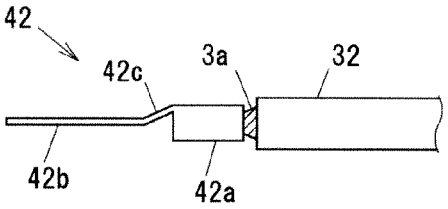
FIGS. 5A and 5B are appearance diagrams illustrating a shape of another connecting terminal provided on the female connector.
Figure 5B:
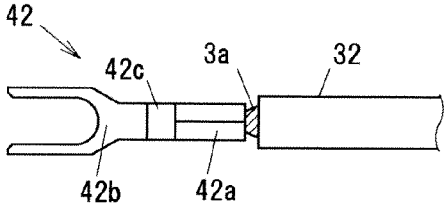

FIG. 4A is a side view showing the connecting terminals 41 and 43, and FIG. 4B is a plan view thereof. Meanwhile, FIG. 5A is a side view showing the connecting terminal 42 and FIG. 5B is a plan view thereof.

In the connecting terminals 41 and 43, caulking portions 41*a* and 43*a* for caulking and fixing the central conductors 3*a* of the wires 31 and 33 are integrally formed with plate-like contact portions 41*b* and 43*b*. Tip portions of the contact portions 41*b* and 43*b* are divided in a fork shape so as to open in an extending direction of the wires 31 and 33. In other words, the connecting terminals 41 and 43 are formed as a Y-terminal.

In the connecting terminal 42, a caulking portion 42*a* for caulking and fixing the central conductor 3*a* of the wire 32 is integrally formed with a plate-like contact portion 42*b* as well as an inclined portion 42*c* which is interposed between the caulking portion 42*a* and the contact portion 42*b* so as to be inclined with respect to the extending direction of the wire 32. The contact portion 42*b* is located on a line extended from a center axis of the central conductor 3*a* of the wire 32. The connecting terminal 42 is also formed as a Y-terminal in the same manner as the connecting terminals 41 and 43

As shown in FIG. 3B, the connecting terminals 41 and 43 are held in the female housing 20 so that the contact portions 41*b* and 43*b* are closest to each other. Then, the connecting terminal 42 is held between the connecting terminals 41 and 43. The contact portion 41*b* of the connecting terminal 41, the contact portion 42*b* of the connecting terminal 42 and the contact portion 43*b* of the connecting terminal 43 are aligned in parallel to each other at equal intervals.

Meanwhile, a circular opening 20*a* is formed on the female housing 20 at a position corresponding to the head portion 81*a* of the connecting member 81 of the male connector 8

Male Connector 8

The male housing 80 of the male connector 8 is composed of an outer housing 82 and an inner housing 83 held by an inner surface of the outer housing 82. The outer housing 82 is formed of, e.g., a metal such as aluminum, etc. The inner housing 83 is formed of a resin, e.g., PPS (polyphenylene sulfide) resin, PPA (polyphthalamide) resin, PA (polyamide) resin or PBT (polybutylene terephthalate) resin, etc. Alternatively, the outer housing 82 may be formed of the same resin as the inner housing 83.

An annular recessed portion 82*a* for housing the head portion 81*a* of the connecting member 81 and rotatably holding the connecting member 81 is formed on the outer housing 82. An annular sealing member 812 for sealing between the head portion 81*a* and the recessed portion 82*a* is held on an outer peripheral surface of the head portion 81*a*.

A front end portion 82*b* of the outer housing 82 is housed in a housing recessed portion 20*b* formed on the female housing 20. Between the outer housing 82 and the female housing 20 is air-tightly sealed by a sealing member 821 held on the outer surface of the front end portion 82*b* of the outer housing 82 and a sealing member 822 which is held inside the housing recessed portion 20*b* so as to be in contact with an inner surface of the front end portion 82*b* of the outer housing 82.

In addition, a raised portion 82*c* protruding toward the recessed portion 82*a* is formed on an inner surface of the outer housing 82 opposite to the recessed portion 82*a*. A screw hole 82*d* is formed on the raised portion 82*c*.

The connecting member 81 has a main body 810 in which a disc-shaped head portion 81*a*, a columnar shaft portion 81*b* formed to have a smaller diameter than the head portion 81*a* and a screw portion 81*c* are integrally formed, and an insulation layer 811 formed on an outer periphery of the shaft portion 81*b*. The shaft portion 81*b* is formed between the head portion 81*a* and the screw portion 81*c*. The screw portion 81*c* is screwed into the screw hole 82*d* of the raised portion 82*c*. The main body 810 is formed of a metal such as iron or stainless steel. Meanwhile, the insulation layer 811 is formed of an insulating resin, e.g., PPS (polyphenylene sulfide) resin, PPA (polyphthalamide) resin, PA (polyamide) resin or PBT (polybutylene terephthalate) resin, etc.

The inner housing 83 supports connecting terminals 91 to 93 which are respectively connected to the connecting terminals 41 to 43. The connecting terminals 91 to 93 each have a plate-like shape on which a though-hole is formed to insert the shaft portion 81*b* of the connecting member 81. The connecting terminals 91 to 93 are aligned in parallel to each other at equal intervals.

In the coupled state of the female connector 2 and the male connector 8, the contact portion 41*b* of the connecting terminal 41 faces the connecting terminal 91, the contact portion 42*b* of the connecting terminal 42 faces the connecting terminal 92 and the contact portion 43*b* of the connecting terminal 43 faces the connecting terminal 93.

A first insulating member 94 is fixed to a surface of the connecting terminal 91 opposite to the surface facing the contact portion 41*b*. Likewise, a second insulating member 95 is fixed to a surface of the connecting terminal 92 opposite to the surface facing the contact portion 42*b*. Also, a third insulating member 96 is fixed to a surface of the connecting terminal 93 opposite to the surface facing the contact portion 43*b*. Furthermore, a fourth insulating member 97 is arranged between the contact portion 43*b* and the raised portion 82*c*. The first to fourth insulating members 94 to 97 are formed of an insulating resin, e.g., PPS (polyphenylene sulfide) resin, PPA (polyphthalamide) resin, PA (polyamide) resin or PBT (polybutylene terephthalate) resin, etc.

Figure 6:
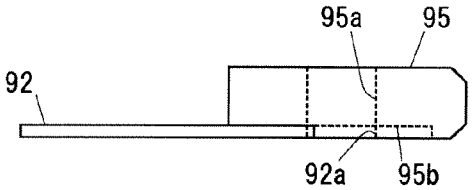
FIG. 6 is a side view showing an appearance of a connecting terminal and a second insulating member.

FIG. 6 is a side view showing an appearance of the connecting terminal 92 and the second insulating member 95. Through-holes 92*a* and 95*a* for inserting the shaft portion 81*b* of the connecting member 81 are respectively formed on the connecting terminal 92 and the second insulating member 95. In addition, on the second insulating member 95, a recessed portion 95*b* depressed in a thickness direction thereof is formed to house an end of the connecting terminal 92. The pair of the connecting terminal 91 and the first insulating member 94 and that of the connecting terminal 93 and the third insulating member 96 are configured in the same manner.

Meanwhile, the first insulating member 94 has an annular recessed portion 94*a* formed on a surface facing the head portion 81*a* of the connecting member 81. The recessed portion 94*a* is formed to surround the shaft portion 81*b* of the connecting member 81. In addition, a ring-shaped washer 941 formed of a metal such as iron or stainless steel is arranged on a bottom of the recessed portion 94*a*.

A coil spring 84 is arranged between the washer 941 and the head portion 81*a* of the connecting member 81. One end of the coil spring 84 is housed in the recessed portion 94*a* and another end of the coil spring 84 is in contact with the head portion 81*a*. Then, the coil spring 84 presses the first insulating member 94 toward the raised portion 82*c* by a restoring force thereof.

Here, in a state before coupling the female connector 2 to the male connector 8, only a front end portion of the screw portion 81*c* of the connecting member 81 is screwed into the screw hole 82*d* of the raised portion 82*c*. Therefore, the head portion 81*a* is located farther from the first insulating member 94 than in the state shown in FIG. 3B and the coil spring 84 is not pressing the first insulating member 94. In other words, the female connector 2 is coupled to the male connector 8 in the state that the first insulating member 94 is not receiving a pressing force toward the raised portion 82*c*.

Laminated Structure of Connecting Terminals 41 to 43 and Connecting Terminals 91 to 93

When the female connector 2 is coupled to the male connector 8, the fork-shaped portions of the contact portions 41*b* to 43*b* of the connecting terminals 41 to 43 enter into positions to face the connecting terminals 91 to 93 so that each fork-shaped portion sandwiches the shaft portion 81*b* of the connecting member 81. Accordingly, the first insulating member 94, the connecting terminal 91, the contact portion 41*b* of the connecting terminal 41, the second insulating member 95, the connecting terminal 92, the contact portion 42*b* of the connecting terminal 42, the third insulating member 96, the connecting terminal 93, the contact portion 43*b* of the connecting terminal 43 and the fourth insulating member 97 are laminated in this order and thereby form a laminated structure as shown in FIG. 3B.

When the connecting member 81 is turned in a direction of screwing the screw portion 81*c* into the screw hole 82*d* of the raised portion 82*c* in such a state that the connecting terminals 91 to 93, the contact portions 41*b* to 43*b* of the connecting terminals 41 to 43 and the first to fourth insulating members 94 to 97 are laminated, the head portion 81*a* of the connecting member 81 moves in a direction of approaching the first insulating member 94 and compresses the coil spring 84. The restoring force of the compressed coil spring 84 acts via the first to fourth insulating members 94 to 97 so that the connecting terminals 91 to 93 come into contact with the contact portions 41*b* to 43*b* of the connecting terminals 41 to 43 at the respective facing surfaces. As a result, it is possible to certainly bring the connecting terminal 91 into contact with the connecting terminal 41, the connecting terminal 92 into contact with the connecting terminal 42 and the connecting terminal 93 into contact with the connecting terminal 43.

Airtight Block 21

The airtight block 21 is formed as a portion of the female housing 20 at an end portion of the female housing 20 on a side where the wires 31 to 33 are led out. The airtight block 21 is an airtight sealing portion for air-tightly sealing the peripheral portions of the wires 31 to 33 so that moisture, etc., does not enter into the female housing 20 through the peripheries of the wires 31 to 33.

As shown in FIG. 1, in the female housing 20, a main body 200 is joined to and integrally formed with a separate part 201. For example, the separate part 201 is vibrated by ultrasonic such that the main body 200 is welded to the separate part 201 by frictional heat generated at a contact portion therebetween, and it is thereby possible to join the main body 200 to the separate part 201. The airtight block 21 is composed of a portion of the main body 200 and the separate part 201. The main body 200 and the separate part 201 are desirably formed of the same type of material, but may be formed of different materials.

As shown in FIGS. 3A and 3B, the insertion hole 21*a* for inserting the wires 31 to 33 is formed on the airtight block 21. A first clamping portion 211 and a second clamping portion 212 which are in contact with the sheaths 3*b* of the wires 31 to 33 for clamping the wires 31 to 33 are formed at both end portions of the insertion hole 21*a* in the extending direction of the wires 31 to 33. The first clamping portion 211 is formed on the outer side of the female housing 20 than the second clamping portion 212. The first clamping portion 211 and the second clamping portion 212 are each divided into two semicircular portions, one on the main body 200 side and another on the separate part 201 side, so as to each form an annular shape by joining the main body 200 to the separate part 201 to clamp the wires 31 to 33.

A recessed portion 210 is formed between the first clamping portion 211 and the second clamping portion 212 so as to be along the outer peripheral surfaces of the wires 31 to 33. A bottom surface 210*a* of the recessed portion 210 is formed to maintain a predetermined distance (e.g., 1 to 5 mm) from the outer peripheral surfaces of the wires 31 to 33. This forms a space 21*b* between the wires 31 to 33 and the insertion hole 21*a*.

Meanwhile, a flow channel 213*a* communicated with the space 21*b* is formed in the airtight block 21. One end of the flow channel 213*a* is opened to the space 21*b* and another end is opened to the fitting recess 213. The flow channel 213*a* is formed linearly extending along an array direction of the wires 31 to 33 in the present embodiment.

In a region of the insertion hole 21*a* corresponding to the first clamping portion 211, a circular holding hole $\mathbf{21}a_1$ surrounding the entire circumference of the wire 31 to hold the wire 31, a circular holding hole $\mathbf{21}a_2$ surrounding the entire circumference of the wire 32 to hold the wire 32 and a circular holding hole $\mathbf{21}a_3$ surrounding the entire circumference of wire 33 to hold the wire 33 are separately formed so as not to communicate with each other, as shown in FIG. 2. In addition, a region corresponding to the second clamping portion 212 is formed in the same shape as the region corresponding to the first clamping portion 211.

Figure 7:
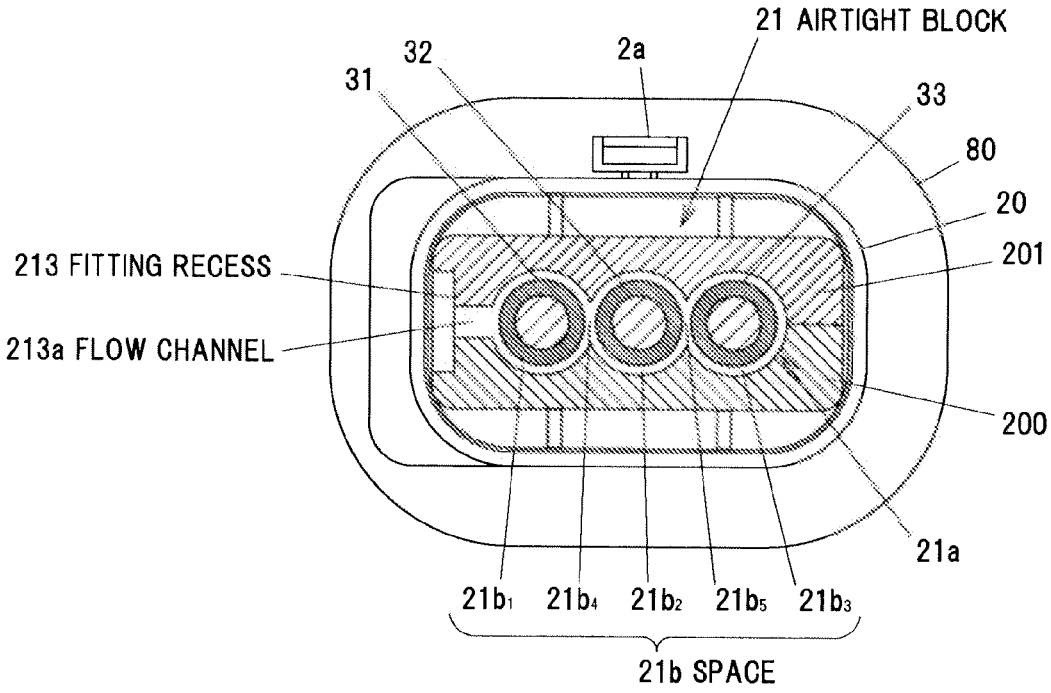
FIG. 7 is a cross sectional view taken along a line D-D in FIG. 1.

FIG. 7 is a cross sectional view taken along a line D-D in FIG. 1. As shown in FIG. 7, in the region of the insertion hole 21*a* corresponding to the recessed portion 210, a space portion $\mathbf{21}b_1$ surrounding the outer periphery of the wire 31, a space portion $\mathbf{21}b_2$ surrounding the outer periphery of the wire 32 and a space portion $\mathbf{21}b_3$ surrounding the outer periphery of the wire 33 are communicated with each other. In more detail, the space portion $\mathbf{21}b_1$ is communicated with the space portion $\mathbf{21}b_2$ through a communicating portion 214 and the space portion $\mathbf{21}b_2$ is communicated with the space portion $\mathbf{21}b_3$ through a communicating portion $\mathbf{21}b_5$. The communicating portion $\mathbf{21}b_4$ is a space formed between the wires 31 and 32, and the communicating portion $\mathbf{21}b_5$ is a space formed between the wires 32 and 33. Then, the space 21*b* is formed by integrating the space portion $\mathbf{21}b_1$, the communicating portion $\mathbf{21}b_4$, the space portion $\mathbf{21}b_2$, the communicating portion $\mathbf{21}b_5$ and the space portion $\mathbf{21}b_3$.

The wires 31 to 33 are clamped by the first clamping portion 211 and the second clamping portion 212 so as to pass through the respective central portions of the space portions $\mathbf{21}b_1$, $\mathbf{21}b_2$ and $\mathbf{21}b_3$.

Melting Tool 5

Next, a structure of a melting tool 5 for supplying the molten resin to the space 21*b* of the airtight block 21 will be described.

Figure 8:
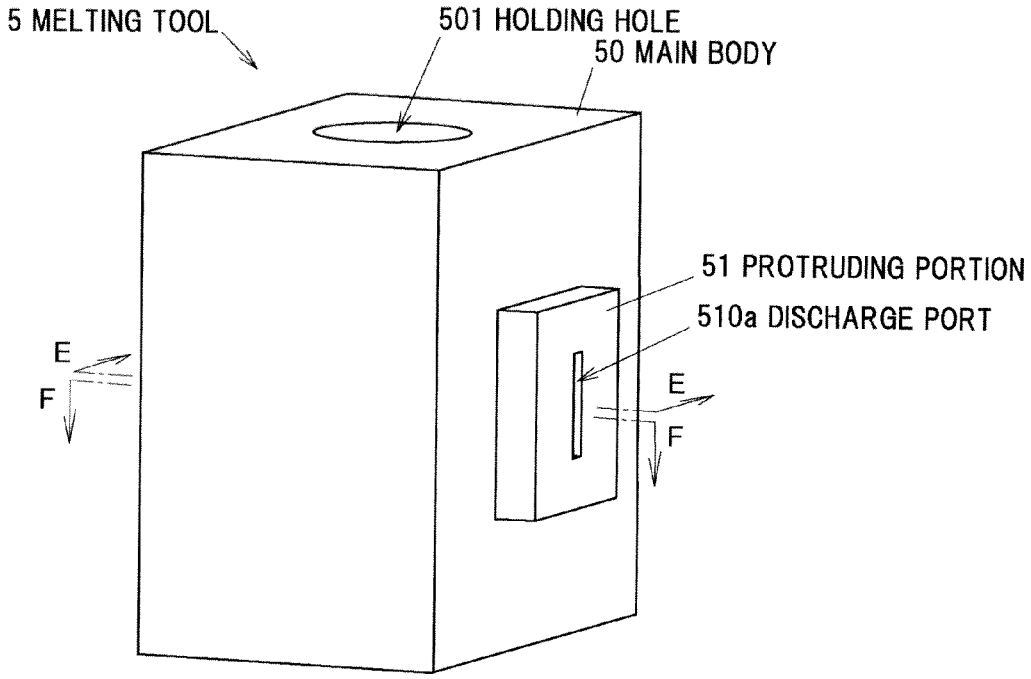
FIG. 8 is a perspective view showing an external shape of a melting tool.

FIG. 8 is a perspective view showing an external shape of the melting tool 5.

Figure 9:
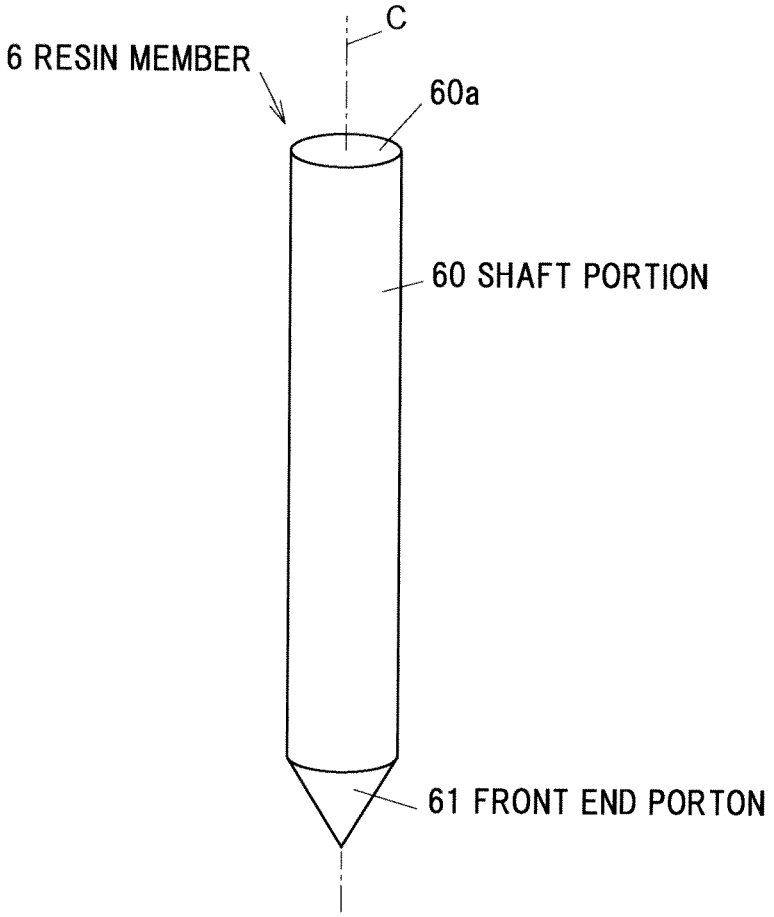
FIG. 9 is a perspective view showing an external shape of a resin member which is melted inside the melting tool.

FIG. 9 is a perspective view showing an external shape of a resin member 6 which is melted inside the melting tool 5.

The resin member 6 is formed of a solid resin such as PPS (polyphenylene sulfide) resin, PPA (polyphthalamide) resin, PA (polyamide) resin or PBT (polybutylene terephthalate) resin, etc.

The resin member 6 is formed in a shaft shape having a circular cross section. In more detail, the resin member 6 integrally includes a columnar shaft portion 60 and a taper-shaped front end portion 61 continuously formed with the shaft portion 60 at one axial end thereof. The front end portion 61 is formed in a cone shape in the present embodiment. The maximum diameter (diameter of a bottom surface of the cone) of the front end portion 61 is the same as a diameter of the shaft portion 60. A flat end face 60*a* orthogonal to a center axis C of the shaft portion 60 is formed at another end of the shaft portion 60

The melting tool 5 is formed of, e.g., a heat resistant resin having a higher melting point than the resin member 6. As shown in FIG. 8, the melting tool 5 integrally includes a main body 50 in a rectangular parallelepiped shape and a protruding portion 51 formed on a side surface of the main body 50. A holding hole 501 for inserting the resin member 6 therethrough is formed on the main body 50. In the holding hole 501, the resin member 6 is held so as to be movable in an axial direction thereof. In addition, a discharge port 510*a* for discharging a resin as the molten resin member 6 is formed on the protruding portion 51.

Figure 10:
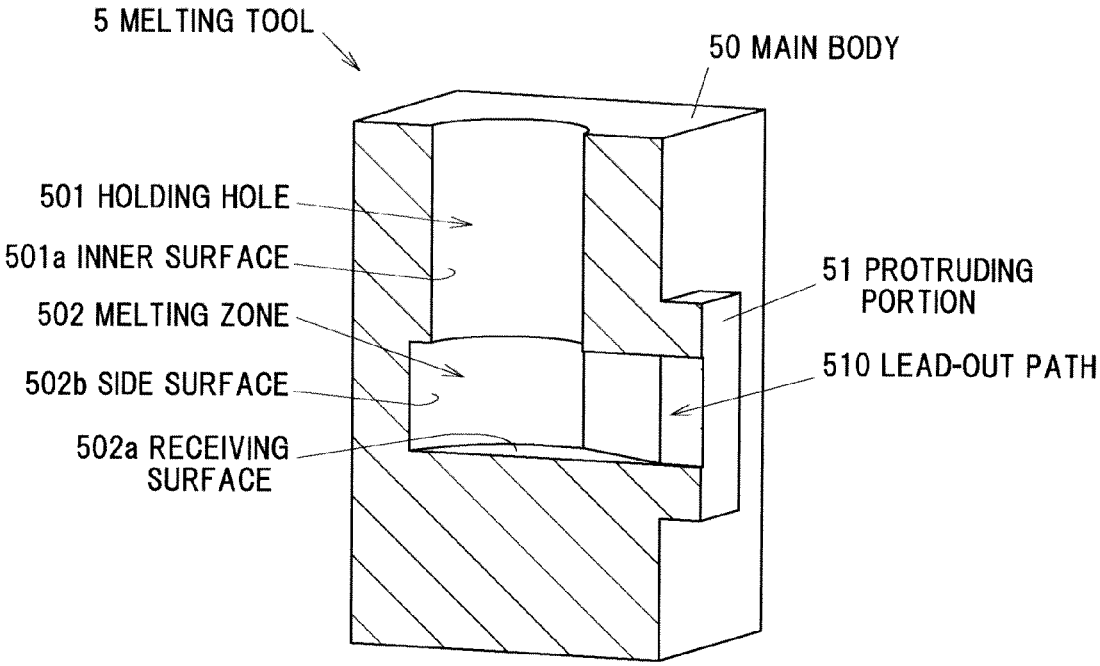
FIG. 10 is a cutaway perspective view showing the melting tool 5 taken along a line E-E in FIG. 8.

FIG. 10 is a cutaway perspective view showing the melting tool 5 taken along a line E-E in FIG. 8. An inner surface 501*a* of the holding hole 501 is formed in a cylindrical shape. A melting zone 502 for melting the resin member 6 is formed in the main body 50 of the melting tool 5 so as to be in communication with holding hole 501. The melting zone 502 is a region which is formed inside the melting tool 5 and includes a receiving surface 502*a* against which an end of the resin member 6 is pressed and a side surface 502*b* formed around the receiving surface 502*a*. The receiving surface 502*a* is a flat surface orthogonal to an extending direction of the holding hole 501. The melting zone 502 is configured to melt the resin member 6 by frictional heat generated by friction between the resin member 6 vibrated by ultrasonic and the receiving surface 502*a*.

Meanwhile, a lead-out path 510 for guiding a liquid resin as the molten resin member 6 to the outside of the melting tool 5 is formed in the protruding portion 51 of the melting tool 5. The holding hole 501 and the melting zone 502, and also the melting zone 502 and the lead-out path 510, are respectively communicated with each other, and the melting zone 502 is provided between the holding hole 501 and the lead-out path 510.

Figure 11:
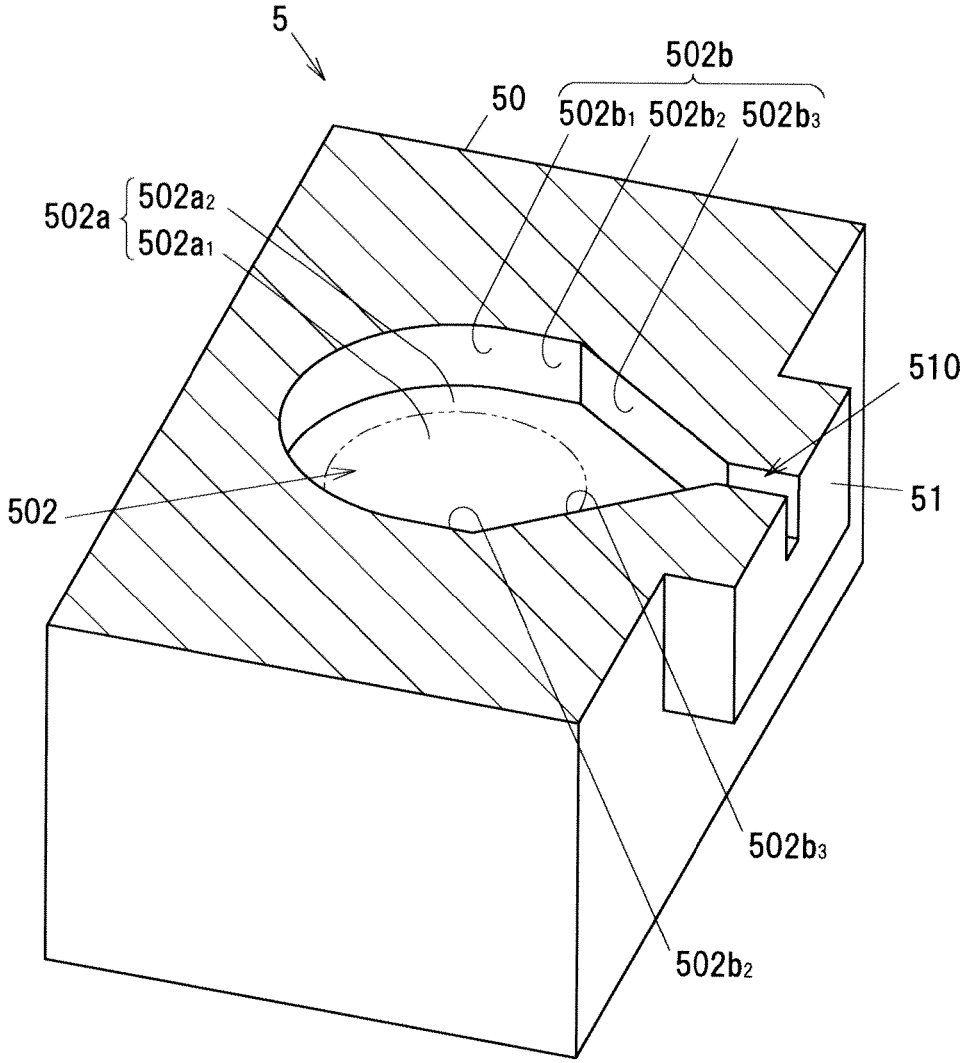
FIG. 11 is a cutaway perspective view showing the melting tool 5 taken along a line F-F in FIG. 8.

FIG. 11 is a cutaway perspective view showing the melting tool 5 taken along a line F-F in FIG. 8. The receiving surface 502*a* is composed of a friction area $502a_1$ in which friction with the resin member 6 occurs and a non-friction area $502a_2$ in which friction with the resin member 6 does not occur. The non-friction area $502a_2$ is formed to surround the friction area $502a_1$.

The side surface 502*b* is formed orthogonal to the receiving surface 502*a*, and is composed of an circular arc surface $502b_1$ in a semi-circular shape, a pair of flat surfaces $502b_2$ facing each other and continued to both circumferential ends of the arc surface $502b_1$ and a pair of taper surfaces $502b_3$ forming a tapered shape and continued to the pair of flat surfaces $502b_2$. The lead-out path 510 is communicated with a gap between the pair of taper surfaces $502b_3$. The pair of taper surfaces $502b_3$ forms a funnel shape which collects and pours the molten resin into the lead-out path 510.

Figure 12B:
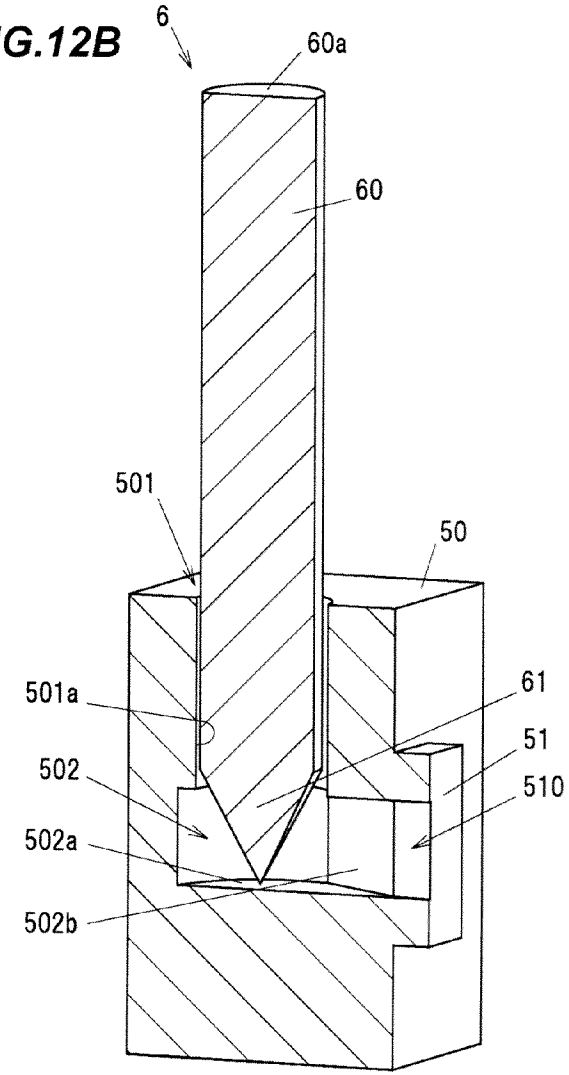
Figure 12A:
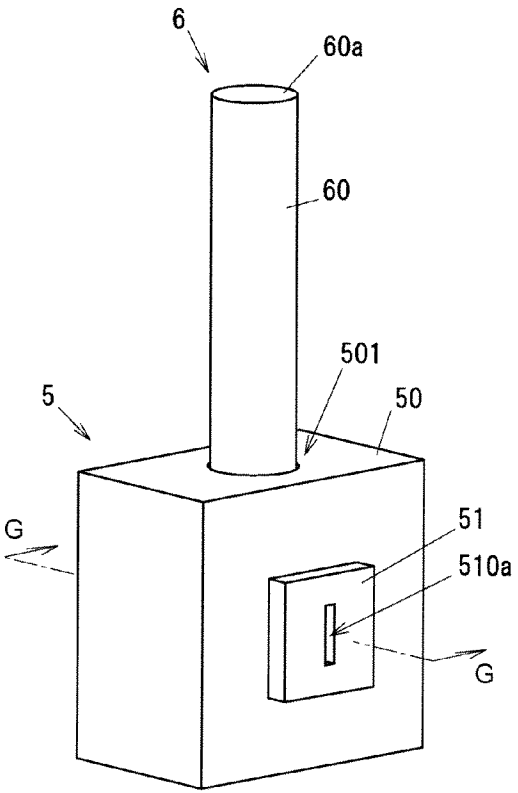

FIGS. 12A and 12B show a state that the resin member 6 is held by the melting tool 5, wherein FIG. 12A is a perspective view showing the melting tool 5 and the resin member 6 and FIG. 12B is a cross sectional view taken along a line G-G in FIG. 12A. An end of the resin member 6 on the front end portion 61 side is inserted into and held by the holding hole 501 of the melting tool 5. A portion of the shaft portion 60 is held by the holding hole 501 and the end face 60*a* is exposed from the melting tool 5.

As shown in FIG. 12B, the front end portion 61 of the resin member 6 is in contact with the receiving surface 502*a* in the melting zone 502 of the melting tool 5. The resin member 6 is held so as to have a slight gap between the shaft portion 60 and the inner surface 501*a* of the holding hole 501.

When ultrasonic vibration is applied to the resin member 6, a contact point of the front end portion 61 of the resin member 6 with the receiving surface 502*a* is initially melted, and after the entire front end portion 61 is melted, the shaft portion 60 then comes into contact with the receiving surface 502*a* and is melted. As described above, the resin member 6 is formed in such a shape that a contact surface with the receiving surface 502*a* gradually increases with progress of melting.

Figure 13:
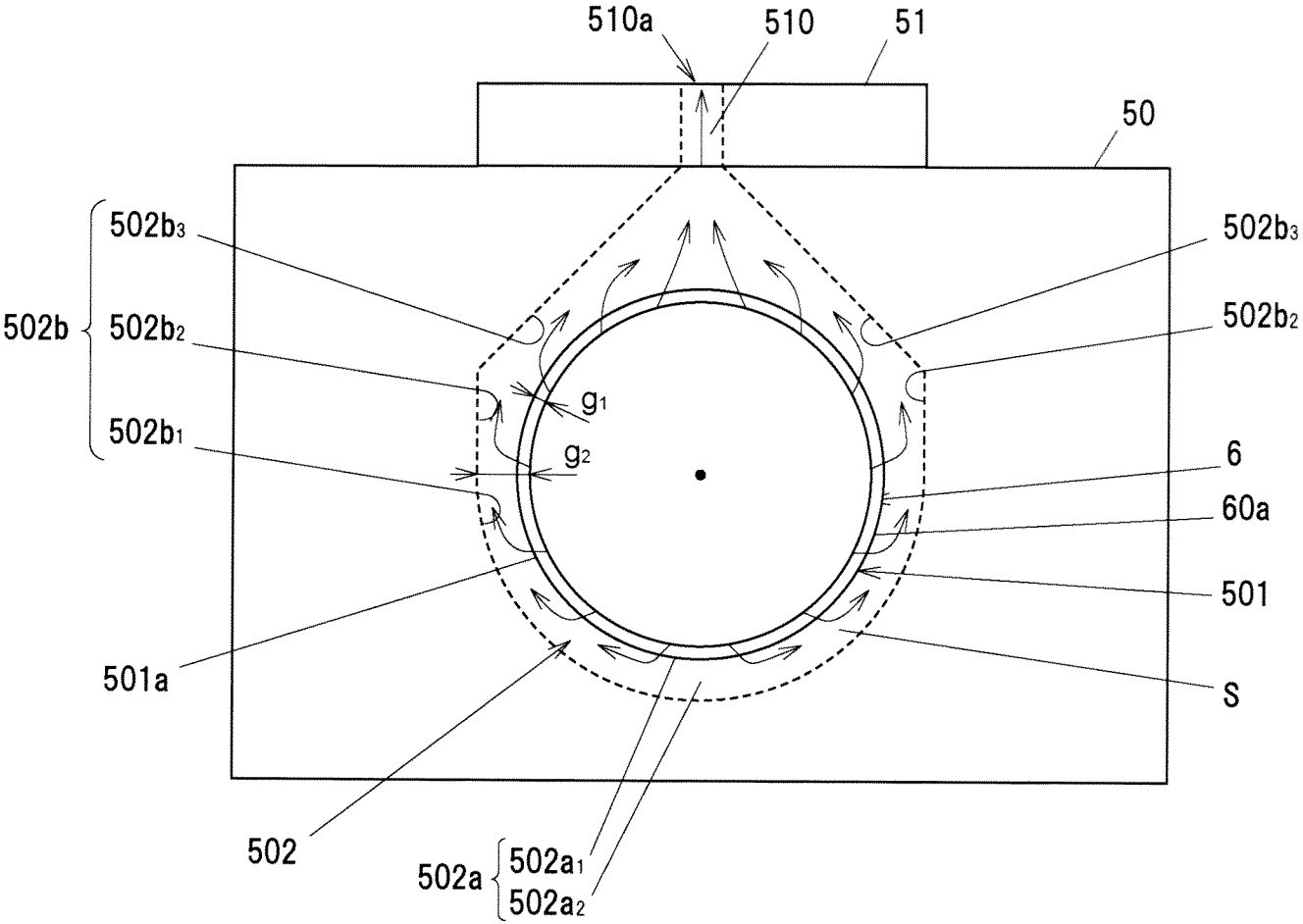
FIG. 13 is a plan view showing the melting tool and the resin member held thereby as viewed in a center axis direction of the resin member.

FIG. 13 is a plan view showing the melting tool 5 and the resin member 6 held thereby as viewed in a direction of the center axis C of the resin member 6. In FIG. 13, the melting zone 502 and the lead-out path 510 which are formed inside the melting tool 5 are indicated by a dashed line. In addition, a flow direction of the resin as the molten resin member 6 is indicated by plural arrows.

When the resin member 6 is vibrated by ultrasonic while being pressed toward the receiving surface 502*a*, friction with the friction area $502a_1$ of the receiving surface 502*a* occurs and the resin member 6 is melted by frictional heat generated by the friction. A molten resin in the form of a liquid, which is produced by melting, flows in the non-friction area $502a_2$ of the receiving surface 502*a* along the side surface 502*b* and is discharged to the outside of the melting tool 5 through the lead-out path 510.

As described above, in the melting zone 502, an annular space S is formed in the non-friction area $502a_2$ on the holding hole 501 side around the friction area $502a_1$ of the receiving surface 502*a*. The space S has a gap $g_2$ which is formed between the side surface 502*b* and the outer surface of the resin member 6 and is larger than a gap $g_1$ between the inner surface 501*a* of the holding hole 501 and the outer surface of the resin member 6.

Method of Manufacturing the Wire Harness 1

A manufacturing process of the wire harness 1 includes an alignment step in which the wires 31 to 33 are aligned in the airtight block 21, which has the insertion hole 21*a* for inserting the wires 31 to 33 therethrough, so as to provide the space 21*b* between the wires 31 to 33 and the inner surface of the insertion hole 21*a*, a supplying step in which a resin having fluidity as the molten resin member 6 is supplied to the space 21*b* through the flow channel 213*a* in communication with the space 21*b* and a solidification step in which the resin flown into the space 21*b* is solidified therein to resin-seal a gap between the airtight block 21 and the wires 31 to 33

For performing the alignment step, the main body 200 and the separate part 201 of the female housing 20 are each formed by injection molding, etc., the front end portions of the wires 31 to 33 caulked and fixed to the connecting terminals 41 to 43 are inserted into the female housing 20 before joining the main body 200 to the separate part 201, and the separate part 201 is joined to the main body 200 so as to clamp the wires 31 to 33 by the first clamping portion 211 and the second clamping portion 212.

In the supplying step, the protruding portion 51 of the melting tool 5 is connected to the airtight block 21, the resin member 6 held by the melting tool 5 is melted by applying ultrasonic vibration while being pressed against the melting tool 5 and the molten resin is poured into the flow channel 213*a* from the discharge port 510*a* of the protruding portion 51

Figure 14A:
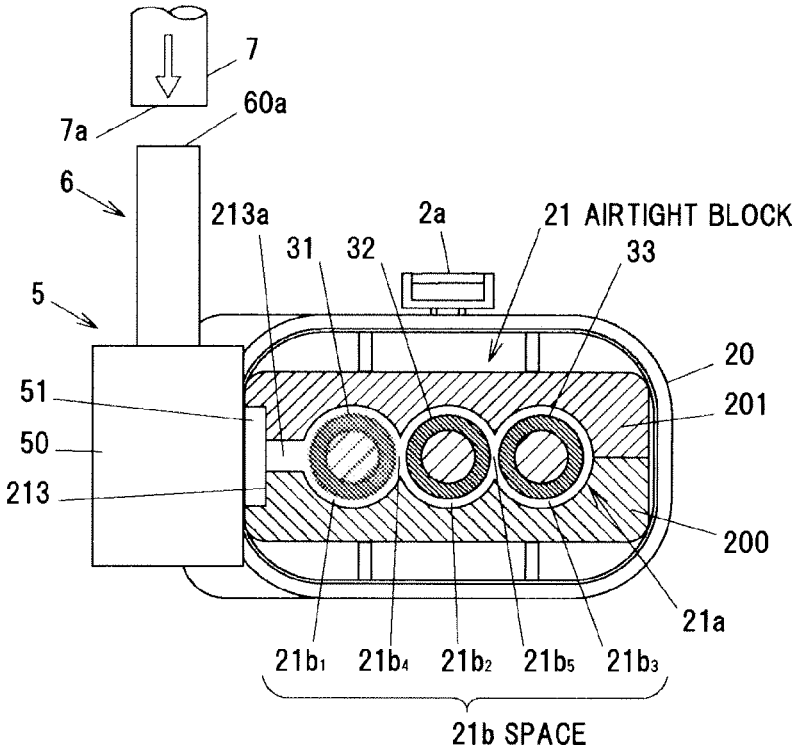
Figure 14B:
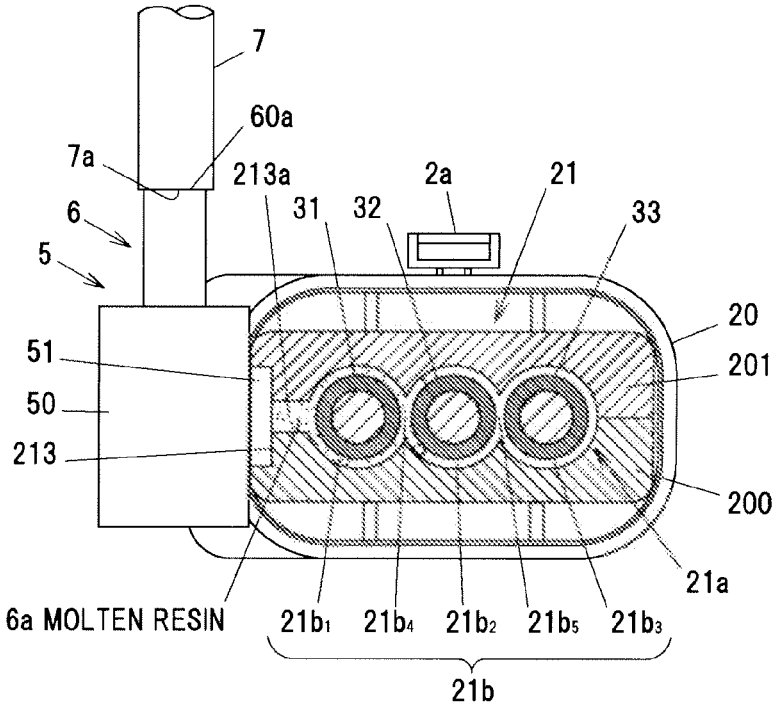

FIGS. 14A and 14B are explanatory diagrams illustrating the melting tool 5 and the resin member 6 in the supplying step and also show cross sectional views of the airtight block 21, wherein FIG. 14A shows a state before applying ultrasonic vibration to the resin member 6 and FIG. 14B shows a state that the ultrasonic vibration is being applied to the resin member 6.

In the present embodiment, the melting tool 5 is attached to the airtight block 21 by fitting the protruding portion 51 of the melting tool 5 to the fitting recess 213 formed on the airtight block 21. The lead-out path 510 (shown in FIG. 13, etc.) of the melting tool 5 communicates with the flow channel 213*a* due to fitting of the protruding portion 51 to the fitting recess 213.

An ultrasonically vibrating horn 7 is connected to the end face 60*a* of the shaft portion 60 and vibration of the horn 7 is transmitted to the resin member 6, thereby applying ultrasonic vibration to the resin member 6. The horn 7 and the resin member 6 are connected by, e.g., bonding a front end face 7*a* of the horn 7 to the end face 60*a* of the shaft portion 60 using an adhesive. The horn 7 is connected to an ultrasonic wave oscillator (illustration omitted) converting electrical energy into vibration and moves back and forth in a center axis direction thereof while vibrating in an ultrasonic frequency band. Vibration frequency of the horn 7 is, e.g., 15 to 70 kHz.

The horn 7 applies vibration to the resin member 6 while pressing the resin member 6 against the melting tool 5 (the receiving surface 502*a*). The resin member 6 is melted at the contact point with the receiving surface 502*a* by frictional heat generated by vibration and is turned into a molten resin 6*a* having fluidity. The molten resin 6*a* is produced by friction with the friction area 502$a_1$ of the receiving surface 502*a*, flows in the space S around the friction area 502$a_1$ so as to be guided to the lead-out path 510, and is supplied to the space 21*b* through the discharge port 510*a* and the flow channel 213*a* of the airtight block 21. When the space 21*b* is filled with the molten resin 6*a*, application of vibration to the resin member 6 by the horn 7 is stopped and the supplying step is finished. The melting tool 5 is detached from the airtight block 21 after finishing the supplying step.

In the solidification step, the temperature of the molten resin 6*a* filled in the space 21*b* is lowered by quenching or natural heat dissipation. When the temperature of the molten resin 6*a* reaches the melting point or less, the molten resin 6*a* is solidified and becomes a resin seal which seals between the inner surface of the insertion hole 21*a* and the wires 31 to 33. As a result, a gap between the airtight block 21 and the wires 31 to 33 is sealed with the resin.

Functions and Effects of the First Embodiment

The following functions and effects are obtained in the first embodiment.

(1) The resin member 6 is melted outside the airtight block 21 and the molten resin 6*a* as the molten resin member 6 is supplied to the space 21*b* through the flow channel 213*a*. As a result, the airtight block 21 does not directly receive heat generated by vibration unlike, e.g., the case of melting a resin inside the airtight block 21 by applying vibration, hence, deformation of the airtight block 21 is suppressed.

(2) Since the space S in the melting zone 502 of the melting tool 5 has the gap $g_2$ which is formed between the side surface 502*b* and the outer surface of the resin member 6 and is larger than the gap $g_1$ between the inner surface 501*a* of the holding hole 501 and the outer surface of the resin member 6, the space S functions as a pressure relief portion for releasing pressure of the molten resin 6*a* generated by friction with the friction area 502$a_1$ of the receiving surface 502 and it is thereby possible to suppress inclination of the resin member 6 in the melting tool 5. That is, if the circular arc surface 502$b_1$ of the side surface 502*b* of the melting zone 502 is an extension of the inner surface 501*a* of the holding hole 501 and the gap $g_1$ is the same as the gap $g_2$, the front end portion of the resin member 6 may be inclined to separate from the circular arc surface 502$b_1$ due to pressure of the molten resin 6*a* flown out toward the circular arc surface 502$b_1$ from the friction area 502$a_1$. However, in the present embodiment, it is possible to reduce such pressure by forming the space S and it is thereby possible to suppress inclination of the resin member 6.

(3) The resin member 6 has the front end portion 61 formed in a cone shape. Therefore, an apex of the front end portion 61 is firstly melted by coming into contact with the receiving surface 502*a* at the beginning of melting the resin member 6 and a contact area with the receiving surface 502*a* gradually increases as the resin member 6 is melted. As a result, the resin member 6 smoothly begins to melt.

(4) Since it is not necessary to provide a zone for melting the resin member 6 in the airtight block 21, it is possible to downsize and lighten the female housing 20. In addition, since it is possible to simplify the shape of the female housing 20 as compared to the case where a zone for melting the resin member 6 is provided in the airtight block 21, it is easy to mold the female housing 20 and it is thus possible to reduce cost of a molding die for molding the female housing 20.

(5) Since the melting tool 5 holds the resin member 6 by the holding hole 501 and melts the resin member 6 at the receiving surface 502*a* which is orthogonal to the extending direction of the holding hole 501, it is not necessary to separately provide a supporting member for maintaining the position of the resin member 6 to be orthogonal to the receiving surface 502*a* and it is thus possible to simplify a structure of a manufacturing equipment.

(6) Since the melting tool 5 is formed of a heat resistant resin having a higher melting point than the resin member 6, melting of the receiving surface 502*a* due to ultrasonic vibration of the resin member 6 is suppressed. In addition, since thermal conductivity is lower than the case of forming the melting tool 5 from, e.g., metal such as iron, it is possible to suppress a temperature decrease of the molten resin 6*a* inside the melting tool 5.

(7) Regardless of cubic capacity of the space 21*b* of the airtight block 21, it is possible to determine a diameter or a length of the resin member 6. Therefore, if the resin member 6 with volume allowing resin-sealing of plural female housings 20 is placed in the melting tool 5, replacement of the resin member 6 and connection of the resin member 6 to the horn 7 per each individual female housing 20 are not necessary and it is thus possible to efficiently manufacture the wire harness 1.

(8) Since the space portion 21$b_1$ around the outer periphery of the wire 31, the space portion 21$b_2$ around the outer periphery of the wire 32 and the space portion 21$b_3$ around the outer periphery of the wire 33 are communicated with each other, the molten resin 6*a* supplied to the space 21*b* from the flow channel 213*a* is sequentially filled around each of the wires 31 to 33. Therefore, it is possible to narrow intervals between the wires 31 to 33 as compared to the case where three wires are respectively inserted into independent (non-communicated) insertion holes, thereby allowing downsizing and weight reduction of the female housing 20.

Modification of the First Embodiment

Figure 15A:
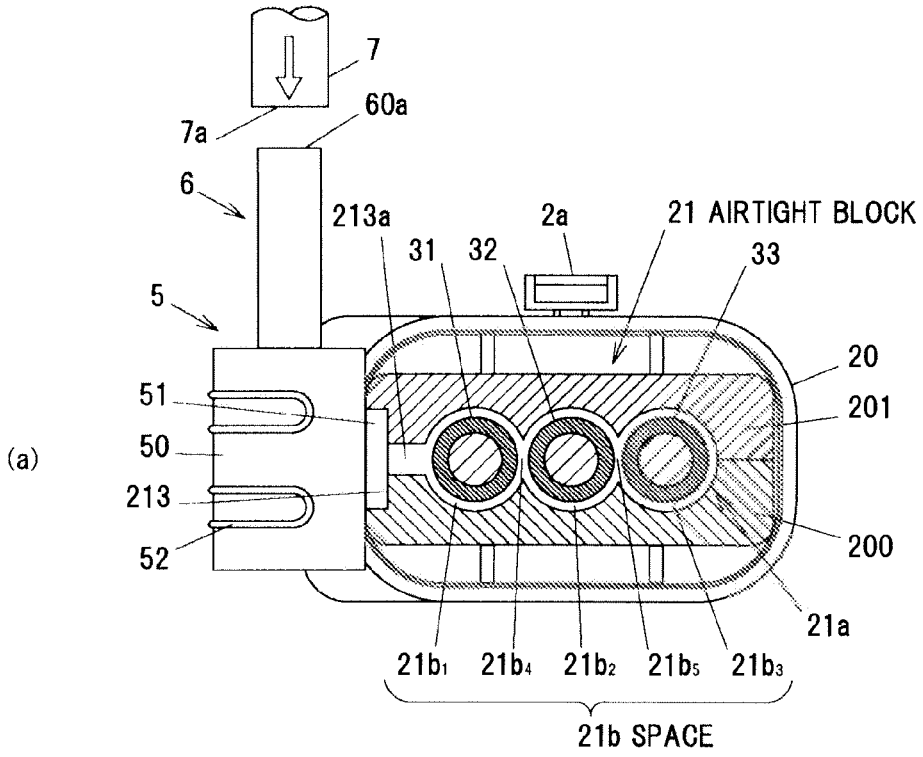
Figure 15B:
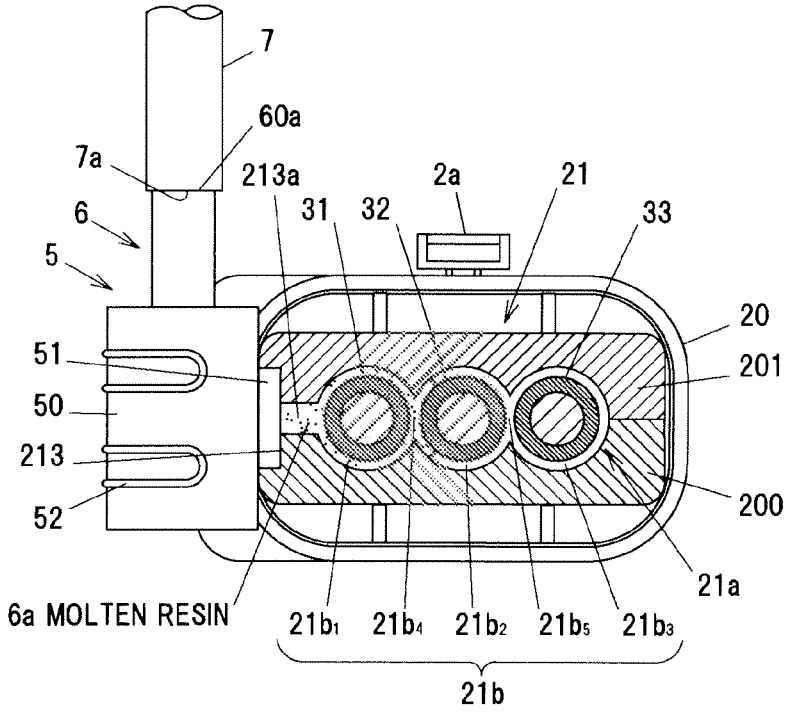

FIGS. 15A and 15B are explanatory diagrams illustrating the melting tool 5 and the resin member 6 in a modification of the first embodiment and also show cross sectional views of the airtight block 21, wherein FIG. 15A shows a state before applying ultrasonic vibration to the resin member 6 and FIG. 15B shows a state that the ultrasonic vibration is being applied to the resin member 6. In FIGS. 15A and 15B, the same constituent elements as those described in the first embodiment are denoted by the same reference numerals and the overlapped explanation will be omitted.

In this modification, a configuration that a heating wire 52 as a heating means is provided on the melting tool 5 is different from the first embodiment, and other configurations and the procedure in the manufacturing process are the same as those in the first embodiment. In addition, in this case, it is desirable that the melting tool 5 be formed of a material having high thermal conductivity. Such a material includes, e.g., metals such as iron or stainless steel.

The heating wire 52 generates heat by energization, thereby heating the melting tool 5. In the supplying step, the resin member 6 is melted in a state that the melting tool 5 is being heated by the heating wire 52. Temperature of the melting zone 502 and the lead-out path 510 of the melting tool 5 should be maintained to a predetermined temperature (e.g., 50° C.) or more which allows the molten resin 6*a* to smoothly flow at least while vibrating the resin member 6. In order to maintain the predetermined temperature, the resin member 6 may be vibrated while heating the melting tool 5 by the heating wire 52 or application of vibration to the resin member 6 may be started in a state that the melting tool 5 is preheated.

In this modification, in addition to the functions and effects of the first embodiment, the molten resin 6*a* can flow smoothly inside the melting tool 5 by applying vibration to the resin member 6 in the state that the melting tool 5 is preheated. In addition, a temperature decrease in the molten resin 6*a* during flowing inside the melting tool 5 is suppressed and the molten resin 6*a* can flow smoothly also inside the airtight block 21.

Although the case of using the heating wire 52 as a heating means has been described in the above modification, the same functions and effects are obtained when heating the melting tool 5 by an infrared-ray irradiation device for irradiating an infrared-ray or an electromagnetic wave irradiation device for radiating an electromagnetic wave.

Second Embodiment

Next, the second embodiment of the invention will be described in reference to FIGS. 16A and 16B.

Figure 16A:
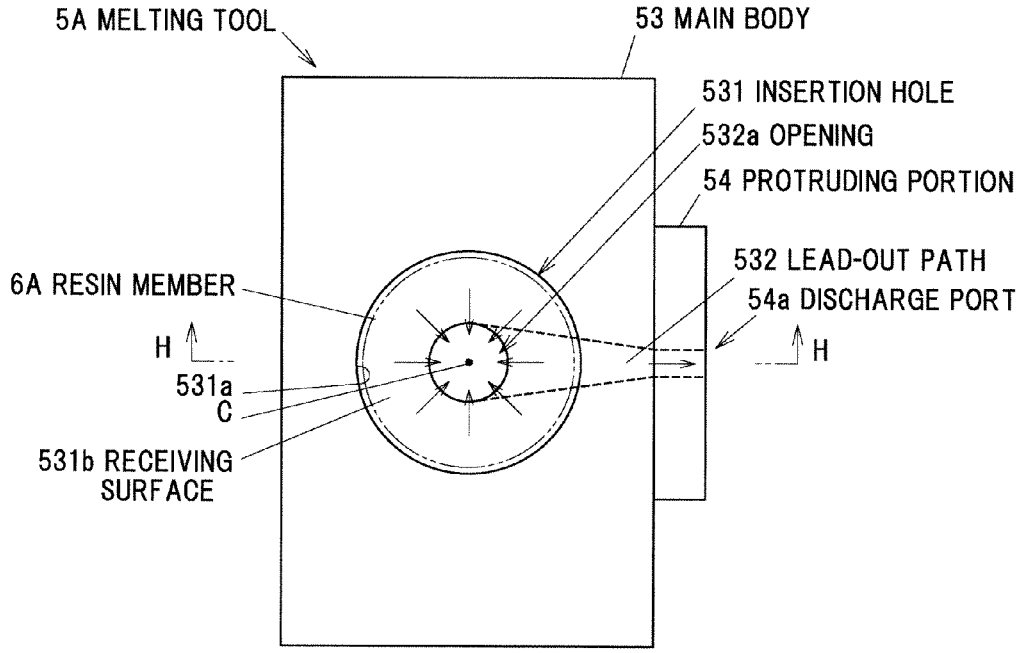
Figure 16B:
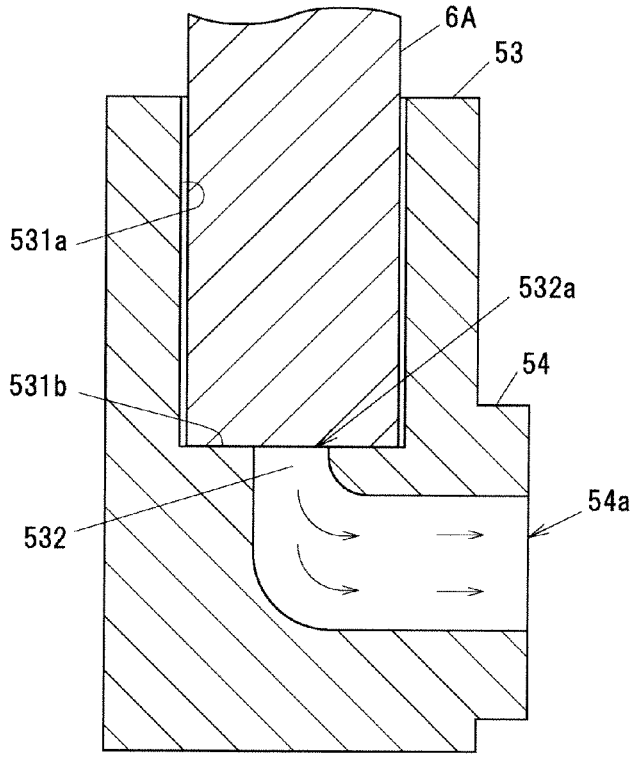

FIGS. 16A and 16B are diagrams illustrating a melting tool 5A and a resin member 6A in a second embodiment, wherein FIG. 16A is a plan view and FIG. 16B is a cross sectional view taken along a line H-H in FIG. 16A. An outline of the columnar resin member 6A inserted into the melting tool 5A is indicated by a chain double-dashed line in FIG. 16A, and FIG. 16B shows a cross section along the center axis C of the resin member 6A. The melting tool 5A is attached to the airtight block 21 of the female housing 20 and supplies a molten resin to the space 21*b* of the airtight block 21 in the same manner as the melting tool 5 in the first embodiment.

The melting tool 5A is formed of a metal, e.g., iron, stainless steel or aluminum, etc., and integrally includes a main body 53 and a protruding portion 54. The melting tool 5A has an insertion hole 531 for inserting the resin member 6A therethrough and a lead-out path 532 in communication with the insertion hole 531 for guiding a liquid resin, which is the resin member 6A melted by applying ultrasonic vibration, to the outside of the melting tool 5A.

The insertion hole 531 is formed to hold the resin member 6A so as to have a slight gap between the resin member 6A and an inner surface 531*a*. A receiving surface 531*b* against which an end portion of the resin member 6A is pressed is formed on a bottom of the insertion hole 531. The receiving surface 531*b* has an annular shape with an opening 532*a* formed at the center thereof. The insertion hole 531 is communicated with the lead-out path 532 through the opening 532*a*. The opening 532*a* is formed to have a diameter smaller than that of the insertion hole 531.

Friction with the resin member 6A occurs on the receiving surface 531*b* except an outer rim portion thereof. The opening 532*a* is formed at a position surrounded by a region of the receiving surface 531*b* in which the friction with the resin member 6A occurs.

One end of the lead-out path 532 is opened to the outside of the melting tool 5A at a discharge port 54*a* formed on the protruding portion 54 and another end is opened on the receiving surface 531*b* at the opening 532*a*.

When ultrasonic vibration is applied to the resin member 6A and friction occurs between the end portion of the resin member 6A and the receiving surface 531*b*, the resin member 6A is melted by frictional heat generated by the friction. The molten resin flows into the lead-out path 532 from the opening 532*a* and is discharged to the outside of the melting tool 5A from the discharge port 54*a* as indicated by arrows in FIG. 16A.

In the present embodiment, in addition to the effects of the first embodiment described in (1) and (4) to (6), pressure of the molten resin acts symmetrically in every radial direction toward the center axis C of the resin member 6A and inclination of the resin member 6A is suppressed.

Modification of the Second Embodiment

Figure 17A:
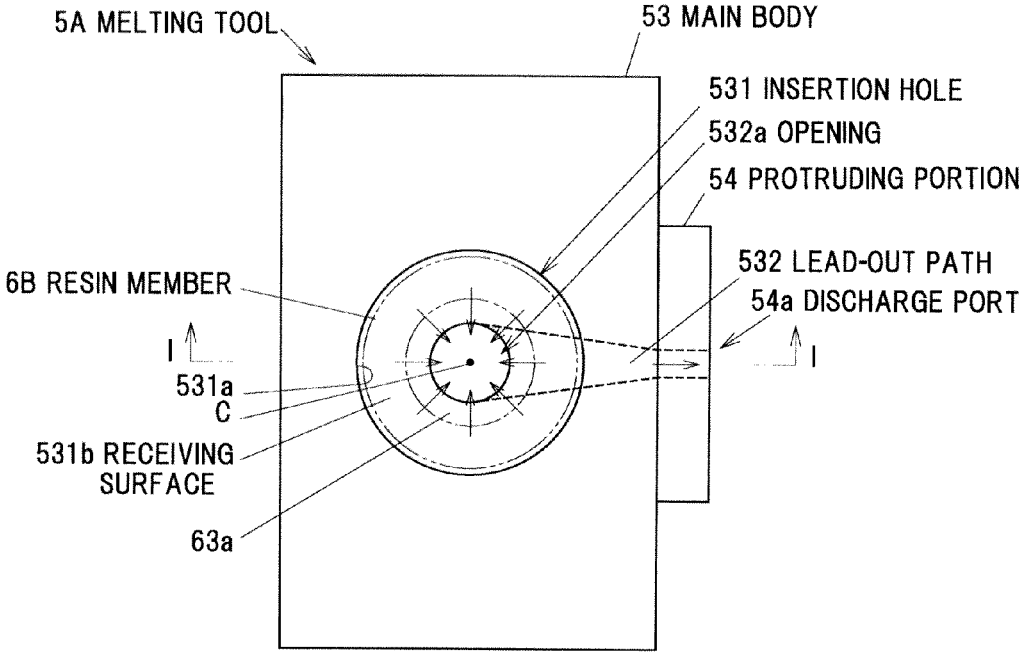
Figure 17B:
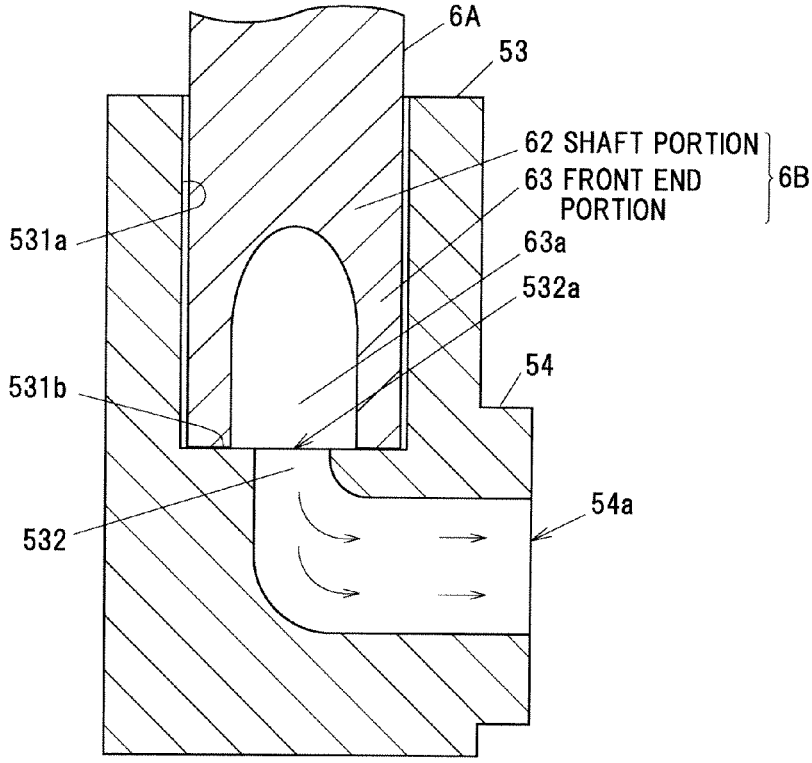

FIGS. 17A and 17B are diagrams illustrating the melting tool 5A and a resin member 6B in a modification of the second embodiment, wherein FIG. 17A is a plan view and FIG. 17B is a cross sectional view taken along a line I-I in FIG. 17A. An outline of the columnar resin member 6B inserted into the melting tool 5A is indicated by a chain double-dashed line in FIG. 17A, and FIG. 17B shows a cross section along the center axis C of the resin member 6B. In FIGS. 17A and 17B, the same constituent elements as those described in the second embodiment are denoted by the same reference numerals and the overlapped explanation will be omitted.

Although the case of melting the columnar resin member 6A has been described in the second embodiment, the resin member 6B of the present modification is different from the resin member 6A of the second embodiment in that a front end portion 63 to be housed in the melting tool 5A has a cylindrical shape having a hollow 63*a* thereinside and is integrally formed with a columnar shaft portion 62.

When the resin member 6B is vibrated by ultrasonic, the front end portion 63 is melted by friction with the receiving surface 531*b*, and the molten resin is temporarily accumulated inside the hollow 63*a* and then flows into the lead-out path 532 from the opening 532*a* As a result, the resin member 6B smoothly begins to melt as compared to the case of using the columnar resin member 6A and a backflow of the molten resin in the insertion hole 531 toward the shaft portion 62 is suppressed.

Although each embodiment of the invention has been described, the invention according to claims is not to be limited to each embodiment. Further, it should be noted that all combinations of the features described in each embodiment are not necessary to solve the problem of the invention.

For example, the application of the wire harness 1 is not limited to supplying an electric current to an electric motor as a drive source of a vehicle, and it is applicable for other purposes. In addition, although the wire harness 1 having three wires 31 to 33 has been described in each embodiment, the number of wires is not limited and may be two or four. A material, etc., of each member is not limited to the one mentioned above, neither.

In addition, although one fitting recess 213 is provided on the airtight block 21 and the melting tool 5 or 5A is fitted thereto in each embodiment, plural fitting recesses 213 may be provided so that the melting tool 5 or 5A is fitted to each of the fitting recesses 213 to supply the molten resin 6*a*. In addition, although the case where the rod-shaped resin member 6 is inserted vertically with respect to the receiving surface 502*a* in the melting tool 5 has been described in each embodiment, the insertion direction of the rod-shaped resin member 6 may be different. For example, the resin member 6 may be inserted in a direction at a predetermined angle (e.g., a 45° direction) or may be inserted horizontally with respect to the receiving surface 502*a* in the melting tool 5. In other words, the insertion direction of the rod-shaped resin member 6 should be appropriately determined so that the molten resin 6*a* can smoothly flow to the lead-out path 510.

What is claimed is:

1. A method of manufacturing a wire harness comprising a plurality of wires and a connector with a housing for holding end portions of the plurality of wires, the method comprising:

arranging the plurality of wires in an insertion hole of an airtight block of the housing to have a gap between the plurality of wires and an inner surface of the insertion hole, the insertion hole being formed in the airtight block for inserting the plurality of wires therethrough;

supplying a molten resin having a fluidity into the gap through a flow channel in communication with the gap; and solidifying the molten resin inside a space to resin-seal the gap between the insertion hole and the plurality of wires, wherein the supplying of the molten resin is conducted such that a tool for melting a solid resin member is attached to the airtight block, the resin member is melted by applying an ultrasonic vibration while being pressed against the tool, and the molten resin obtained by the melting is poured into the flow channel, wherein the tool comprises a holding hole for holding a shaft-shaped resin member so as to be movable in an axis direction thereof, a lead-out path for guiding the molten resin to an outside of the tool, and a melting zone provided between the holding hole and the lead-out path to melt the resin member, and wherein the melting zone comprises a receiving surface against which the resin member is pressed so as to be melted by frictional heat generated by friction between the resin member and the receiving surface.

2. The method according to claim 1, wherein the melting zone comprises a gap that is larger than a gap between an inner surface of the holding hole and the resin member and formed around a region where the friction between the receiving surface and the resin member occurs.

3. The method according to claim 1, wherein the lead-out path is opened to the outside of the tool at one end and opened on the receiving surface at another end, and the opening on the receiving surface side is formed at a position surrounded by the region where the friction with the resin member occurs.

4. A method of manufacturing a wire harness comprising a plurality of wires and a connector with a housing for holding end portions of the plurality of wires, the method comprising:

arranging the plurality of wires in an insertion hole of an airtight block of the housing to have a gap between the plurality of wires and an inner surface of the insertion hole, the insertion hole being formed in the airtight block for inserting the plurality of wires therethrough;

supplying a molten resin having a fluidity into the gap through a flow channel in communication with the gap; and solidifying the molten resin inside a space to resin-seal the gap between the insertion hole and the plurality of wires, wherein the supplying of the molten resin is conducted such that a tool for melting a solid resin member is attached to the airtight block, the resin member is melted by applying an ultrasonic vibration while being pressed against the tool, and the molten resin obtained by the melting is poured into the flow channel, wherein the tool comprises a melting zone comprising a receiving surface, and wherein the resin member has configured such that a contact area with the receiving surface increases according to the melting.

5. The method according to claim 4, wherein the resin member is formed so that an end portion to be housed in the tool has a tapered shape.

6. The method according to claim 4, wherein the resin member has a hollow formed at a shaft center in the end portion to be housed in the tool.

7. The method according to claim 1, wherein the supplying of the molten resin is conducted such that the resin member is melted while the tool is heated by heating means.

* * * * *